United States Patent [19]

Wiener et al.

[11] Patent Number: 4,526,070

[45] Date of Patent: Jul. 2, 1985

[54] PLIERS-TYPE TOOL

[75] Inventors: Hans Wiener, Täby; Hans Undin, Åkersberga, both of Sweden

[73] Assignee: C. A. Weidmüller GmbH & Co., Detmold, Fed. Rep. of Germany

[21] Appl. No.: 526,438

[22] Filed: Aug. 25, 1983

[30] Foreign Application Priority Data

Aug. 26, 1982 [SE] Sweden ..... 8204888

[51] Int. Cl.[3] ..... B25B 7/12

[52] U.S. Cl. ..... 81/361; 81/362; 81/363; 30/242

[58] Field of Search ..... 81/346–347, 81/352–355, 361–363, 367, 373, 375–377; 30/190, 251, 242; 72/409–410

[56] References Cited

U.S. PATENT DOCUMENTS 432,056 7/1890 Leavitt ..... 30/242

3,238,763 3/1966 Tallentire et al. ..... 81/361 X

FOREIGN PATENT DOCUMENTS 1453479 10/1976 United Kingdom .

1522144 8/1978 United Kingdom .

*Primary Examiner*—Frederick R. Schmidt

*Assistant Examiner*—Debra S. Meislin

*Attorney, Agent, or Firm*—Toren, McGeady, Stanger

[57] ABSTRACT

In a pliers-type tool having a stationary first handle and a second handle pivotally movable relative to the first handle, a slidable jaw carrier is movable along a rectilinear guiding track in a body member due to the pivotal movement of the second handle. The first handle is fixed to the body member. The second handle is in engagement with a toggle mechanism including a driver arm which, in turn, is pivotally attached at a stationary location to the body member. When the second handle is pivoted, the driver arm contacts, in a gliding manner, the jaw carrier and moves it rectilinearly in the guiding track. The driver arm extends transversely of the rectilinear guiding direction of the guiding track. Forces acting through the driver arm in the direction transversely of the rectilinear direction of the guiding track are prevented from affecting the movement of the jaw carrier. The second handle can be connected to the first handle by a connecting link.

11 Claims, 8 Drawing Figures

PLIERS-TYPE TOOL

SUMMARY OF THE INVENTION

The present invention is directed to a pliers tool including a body member, a first handle fixed to the body member, so that the handle and body member form a rigid sub-assembly unit. A second handle is pivotally connected to the sub-assembly unit. A working jaw is positioned in the body member so that it executes a vice-like movement relative to another working jaw instead of a scissors-like movement which is more usual in pliers. A tool of this general type is illustrated in FIG. 2 in British Pat. No. 1,453,479 filed on Feb. 2, 1973, by Pressmaster Ltd.

In tools of this general type the movable jaw is displaceable along a rectilinear guiding track and the track is exposed to relatively high stress, because the driver arm (in this description the term "driver arm" is the final member of a toggle mechanism which directly effects the jaw movement) at least temporarily affects the movable jaw—and sometimes with considerable force—in a direction extending obliquely to the direction of movement along the guiding track. The guiding track must be formed to counter the component of force acting at right angles to the direction of movement along the guiding track, however, despite the attempts made, the effects of wear affect the precision of the guiding track, so that an undesirable play in the direction of this force component cannot be totally excluded.

Moreover, in most cases it is desirable in pliers that the movable working jaw acts against a workpiece with greater force in the final phase of the working operation, such as crimping and the like, than at the beginning of the operation when the workpiece offers less resistance.

By "applied force" is meant the ratio W/V where W designates the change of the mutual positions of the handles of the tool, and V the rectilinear approaching motion of the working jaws corresponding to the movement of the handles. In the initial phase of a working operation, a higher value of W/V is desirable so that the total working time is not unnecessarily long, however, in the final phase a lower value of W/V is preferred to achieve a greater force effect per unit of W.

Therefore, it is a primary object of the present invention to provide a pliers-type tool as described above, in which stress acting on the guiding track transversely of the guiding direction of the track is eliminated or at least considerably reduced and in which the value W/V decreases during the course of the working operation.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing.

In the various figures of the drawing, similar reference numerals designate corresponding functional parts.

DETAILED DESCRIPTION OF THE PREFERRED EMBODIMENT

Figure 1:
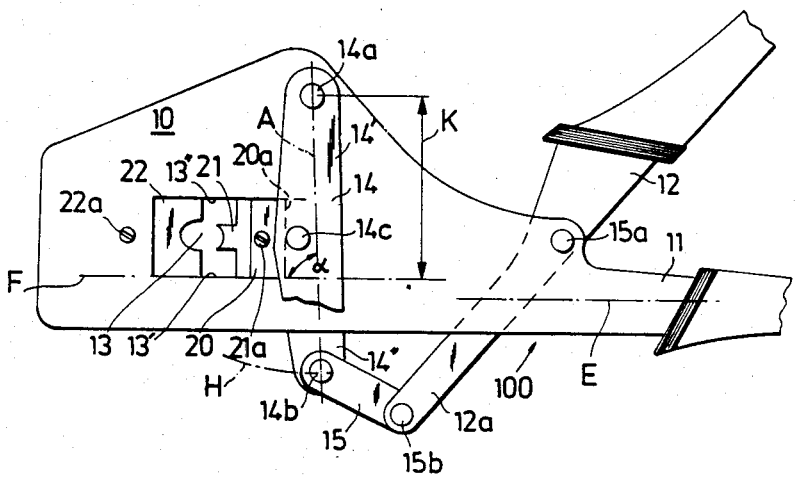
FIG. 1 is a partial side view of a first embodiment of the tool incorporating the present invention.

In the different embodiments similar parts have the same last two reference numerals and, with the exception of FIG. 1, an additional prefix numeral.

In FIG. 1, a pliers-type tool embodying the present invention includes a body member 10 rigidly connected to a first handle 11 and combining to form a sub-assembly 100. A second handle 12 is pivotally connected to the sub-assembly 100 by a pivot pin 15*a*. Second handle 12 has a rigid extension 12*a* projecting outwardly from the handle and extending beyond the pivot pin 15*a* relative to the handle. Body member 10 forms a rectilinear guiding track 13 for a jaw carrier 20 slidably mounted in the track. The jaw carrier is driven through the guide track by the second handle 12. A replaceable first jaw 21 is fixed to the slidable jaw carrier 20 by a retainer screw 21*a*.

As viewed in FIG. 1, the first handle 11 extends in the direction E which is essentially parallel with the direction F of the rectilinear movement in the guiding track 13. At the opposite end of the guiding track 13 from the jaw carrier 20, a second working jaw 22 is fixed in the body member 10 by a retainer screw 22*a*. It can be readily appreciated that the working jaws 21, 22, instead of being interchangeable elements, can be machined directly in the jaw carrier 20 and/or the body member 10.

The arrangement described thus far is conventional with the exception of the specific construction of the guiding track 13. According to the present invention, however, a driver arm 14 in the above-defined sense is not pivoted to the jaw carrier as the member of a toggle mechanism directly affecting the carrier, but a driver arm means is pivoted at a stationary location on the body member 10 by a pivot pin 14*a*. The stationary location is spaced laterally from the guiding track 13 by a distance K extending transversely of the direction F of the recitlinear movement in the guiding track with the distance K being measured to the more remote side of the track from the pivot pin 14*a*. The driving force is transmitted from the second handle 12 through a connecting link 15 to the driver arm 14. Link 15 is connected by means of pivot pins to the driver arm 14 at pivot pin 14*b* and to the extension 12*a* of the handle 12 at the pivot pin 15*b*.

As can be seen in FIG. 1, the elongated direction of the driver arm 14 extends transversely of the direction F of the guiding track 13. A line A extending in the elongated direction of the driver arm 14 connects the pivot points 14*a*, 14*b* located adjacent the opposite ends of the driver arm. Line A at its intersection with the line or direction F forms an angle $\alpha$ extending between 45° and 135° when the tool is in the open position, and as illustrated the angle formed in FIG. 1 between line A and line F is approximately 90°. In the present description, the open position as shown in FIG. 1, is when the jaws 21, 22 are spaced apart and the closed position is when the jaw 21 is maximally approached to the jaw 22. The end position of the jaw carrier is its position when the jaws are in the closed position.

Located approximately centrally on the driver arm means between the pivots points 14*a*, 14*b* is a tap 14*c* in engagement with the rear wall 20*a* of jaw carrier 20 and it is capable of a gliding movement along the carrier in the direction of the line A. A compression or extension spring, not shown, maintains these parts in engagement with one another, even if no working operation is being performed.

Figure 6:
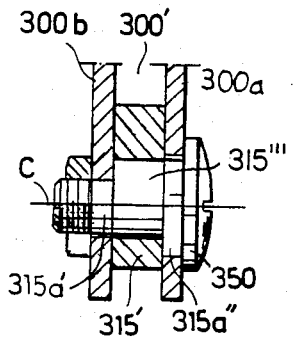
FIG. 6 is an enlarged detail view of a portion of the tool illustrated in FIGS. 4 and 5 and taken along the line VI—VI in FIG. 4.

It is known to make pliers-type tools of the above type, including the handles, of two laterally spaced parts such as 300*a*, 300*b* in FIG. 6 where the parts are sheet metal plates connected by spacers with an open space 300' provided between the two parts. Tools embodying the present invention may advantageously be made in the same manner, with the driver arm means and the connecting link formed either as a single member located in the open space 300', or as a pair of such members, such as driver arms 314', 314'' each located along an opposite outer side face of the tool. In FIG. 1, the tool is provided with a pair of driver arms, each located on an opposite side of the body member 10 and with a single connecting link 15 located between the two driver arms. In this arrangment, the guiding track may be formed by windows 13 located in both of the lateral parts forming the longitudinally extending edges 13', 13'' which extend in the rectilinear direction of movement. The jaw carrier 320 has a central portion protruding more into the open space 300' so that the carrier 320 is guided by the lateral parts in the sidewards direction.

Driver arm means 14 is pivotally connected to the body member 10 at a stationary location and it transmits forces to the jaw carrier 20 acting only in the direction F of the guiding track. Since the guiding track is embodied by a window closed on all sides, and is not defined, as usual, by a guiding member, such as the edge 13', extending only beneath the jaw carrier, this guiding arrangement avoids premature wear of the cooperating faces of the jaw carrier and the guiding track including the upper member or edge 13''. Such wear tends to cause misalignment of the jaws in the end position of the jaw carrier which leads to improper operation when the cooperating surfaces of the working jaws have non-rectilinear configurations.

Figure 2:
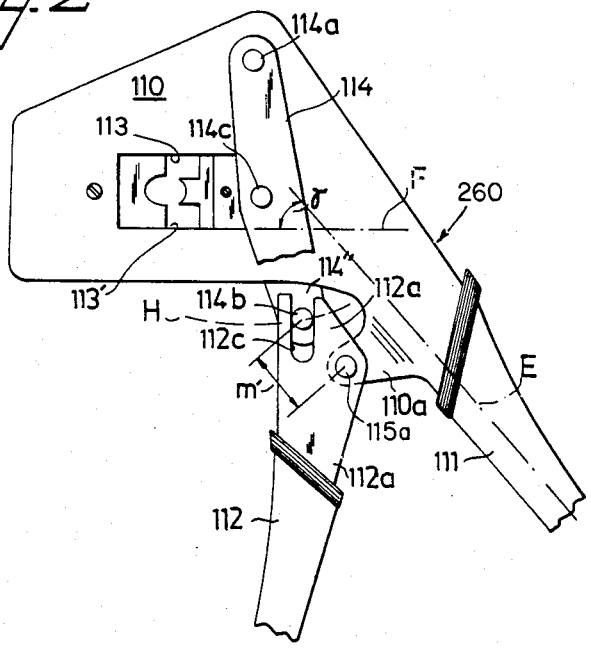
FIG. 2 is a partial side view of a second embodiment of the tool.

In the embodiment of FIG. 2, the elongated direction E of the first handle 111 extends obliquely relative to the direction F of the guiding track 113 and the intersection of these directions forms an angle $\gamma$ of approximately 45°. Second handle 112 is connected by a pivot pin 15*a* to a rigid projection 110*a* of the body member 110. The extension 112*a* of the second handle 112 has a longitudinal slot 112*c* in which a tap 114*b* on the driver arm 114 is slidably guided. The point of engagement between tap 114*b* and the slot 112*c* moves along the slot when the second handle 112 is pivoted, but remains, in the same manner as in the tool of FIG. 1, at a constant distance from the pivot pin 114*a* and the point of engagement moves along a circular path H centered about the axis of the pivot point 114*a*.

Figure 3:
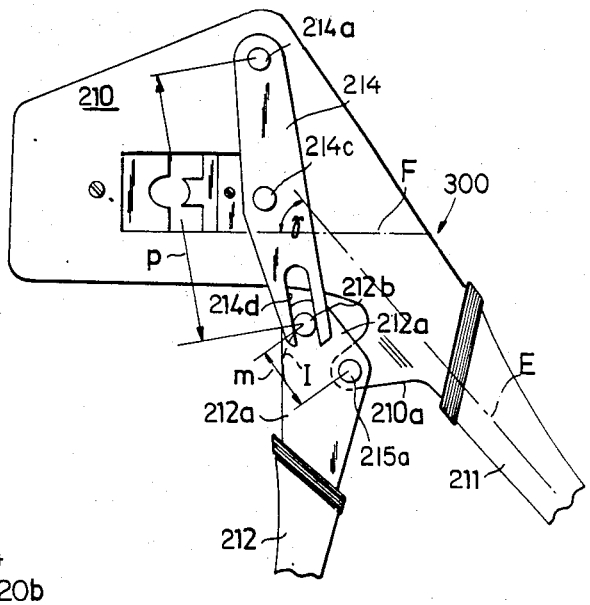
FIG. 3 is a side view of an alternative arrangement of the tool illustrated in FIG. 2.

In FIG. 3 the embodiment illustrated is a kinetic reversal of the embodiment displayed in FIG. 2 in the sense that longitudinal slot 214*d* is located in the end of the driver arm and an engagement tap 212*b* is formed on the extension 212*a* of the second handle 212. Even in this embodiment, the point of contact of the tap 212*a* moves in the slot 214*d* along a circular path I about a fixed center when the handle is pivoted, however, the fixed center in this arrangement is the axis of the tap 215*a*. The kinetic difference between the embodiments of FIGS. 2 and 3, to be discussed in more detail later, involves the fact that the distance m' between taps 114*a* and 15*a* in the tool of FIG. 2 and the distance p between the tap 214*a* and the point of contact in the slot 214*d* in the embodiment of FIG. 3, is somewhat extended when handle 212 is pivoted.

Figure 4:
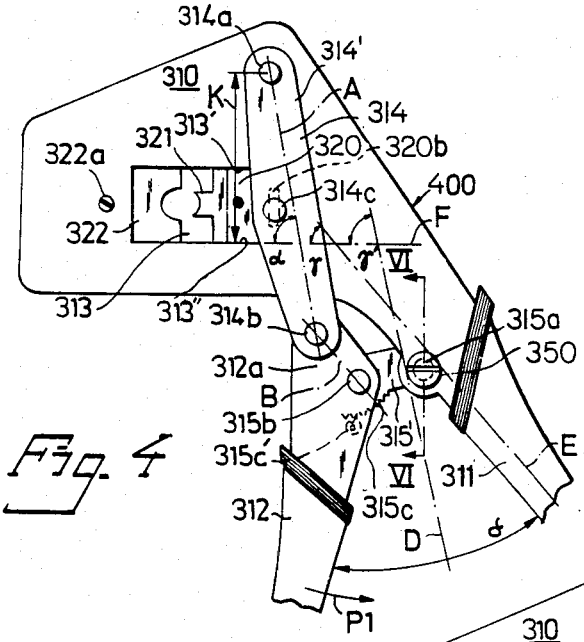
FIG. 4 is a side view of a third embodiment of the tool displayed in the open position.
Figure 5:
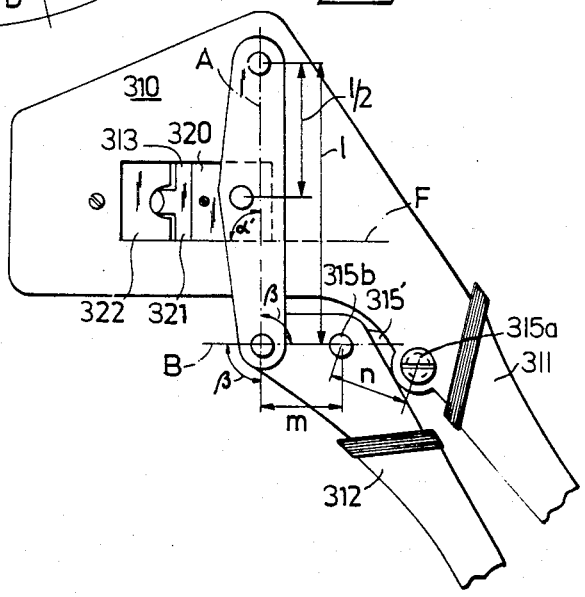
FIG. 5 is a side view of the tool displayed in FIG. 4 but in the closed position.

In a third embodiment according to FIGS. 4 and 5, second handle 312, similar to FIG. 3, is not attached directly to the sub-assembly unit 400 but is connected to it by a connecting link 15', similar to the connecting link 315 in FIG. 1. First handle 311 extends obliquely relative to the body member 310 and preferably so that the direction F of guiding track 313 forms an angle $\gamma$ in the range of 30° to 90° and an angle $\gamma'$ with the bisector D of the opening angle of the two handles in the range of 45° to 90°. The bisector D is established when the first and second handles are in the position most remote from one another. The axis of symmetry is the line which bisects the angle $\delta$ when the handles 311 and 312 are spaced furthest apart.

Driver arm means 314 contacts the jaw carrier 320 in the region between the pivot points 314*a*, 314*b* so that a relative gliding movement in the long direction of the driver arm is possible. As shown in FIG. 4, this movement is attained when the tap 314*c*, firmly secured on the driver arm 314', is approximately in the center of the long dimension of the driver arm and passes through a longitudinally extending opening 320*b* in the carrier 320. A second driver arm 314'', as shown in FIGS. 1 and 2, is located along the reverse side of the body member 310 and the remote end of the tap 314*c* is anchored in the second driver arm. Driver arms 314' and 314'' together define driver arm means 314.

In addition, it can be appreciated that other types of gliding engagement of these two members are possible, for instance, where a tap is firmly anchored in the jaw carrier and glides in longitudinal slots in the driver arms, or the arrangement shown in FIG. 1. In the jaw carrier and in the body member at the ends of the guiding track there are cooperating working jaws as in the other embodiments. In the illustrated example the working jaws are arranged to crimp end connectors onto cables, however, it will be appreciated that working jaws for any arbitrary purpose can be used.

Preferably, the tool may be provided with some known arresting mechanism impeding a premature opening of the handles and of the working jaws. In the illustrated embodiment such a mechanism is shown formed by a circular row of teeth 315*c* and a meshing pawl 315*c'*. A mechanism of this type is disclosed in British Pat. No. 1,522,144 to Holdema Ltd., filed on Oct. 25, 1974 and reference is made to that patent. Alternatively, a blocking mechanism acting between the two handles may be used, such as the kind described in the above-mentioned British Pat. No. 1,453,479.

Further, for the exact setting of the closed end position as shown in FIG. 5, at least one of the taps or pins 314*a*, 314*b*, 314*c*, 315*a* and 315*b* may, in any illustrated embodiment, be made eccentric in a known manner, such as illustrated in FIG. 6 as applied to the tap 315*a* in FIGS. 4 and 5.

Eccentric tap 315*a* as illustrated in FIG. 6 has two end parts 315*a*', 315*a*" of its axially extending shank each of which is concentric relative to the axis C of the shank. Between these two parts 315*a*', 315*a*", there is a central part 315*a*'" which is eccentric relative to the axis C and the connecting link 315' is mounted on the central part. The two concentric parts 315*a*', 315" are mounted in the lateral parts 300*a*, 300*b* of the sub-assembly 400 so that during rotation of the tap 315*a* about axis C, the relative position of the members connected together by the tap can be changed to the extent determined by the degree of eccentricity. To afford such a setting and to lock the set position, tap 315*a* is provided with a slotted end 350 at one end and with a thread at the opposite end onto which a lock nut is screwed. For a more detailed description, reference is made to the above-mentioned British Pat. No. 1,522,144.

The tool, according to the present invention and as disclosed in FIGS. 4 and 5, is arranged so that in the closed position of FIG. 5, but not in the open position of FIG. 4, the driver arm 314, or more precisely the connecting line A extending between the pivot points 314*a*, 314*b*, forms with the direction F of the guiding track 313 substantially a right angle $\alpha'$, or at least an angle in the range of 80° to 100°. The same relation applies to the angle $\beta$ which is formed between connecting line A and connecting line B extending through the pivot points 314*b*, 315*b*, located on the extension 312' of the second handle 312. These angular values afford the best application of force in the final phases of the approaching action of the jaws.

Figure 7:
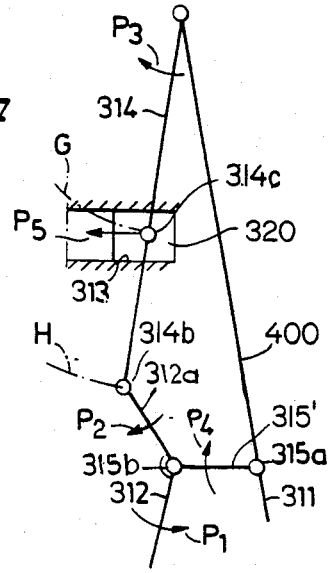
FIG. 7 is a kinetic diagram of the mode of operation of the tool displayed in FIGS. 4 and 5.

The tool embodying the present invention operates in the following manner, as is shown best in FIG. 7.

After a workpiece, not shown, has been placed between the two working jaws 321, 322 in the open state, the tool is operated by pivoting the second handle 312 in the direction toward the first handle 311 as illustrated by the arrow $P_1$. The second handle 312 executes a pivotal movement about the pin 315*b* with the rigid extension 312*a* of the second handle moving in the direction of the arrow $P_2$, opposite to the direction of the arrow $P_1$. As a consequence, driver arm 314 pivots ($P_3$) about the stationary pivot point 314*a* on the body member 310 and transmits forward motion to the jaw carrier 320 in the direction of the arrow $P_5$. Due to the construction of the guiding track 313, the movement in the direction of the arrow $P_5$ is rectilinear. Due to the pivotal movement of the driver arm 14 about the tap 314*a*, the other two taps 314*c*, 314*b* on the driver arm move along circular arc paths G and H, each centered on the tap 14*a*. Two features of the invention afford such movement. As one of the features, the engagement of the driver arm 314 with jaw carrier 320 is arranged in a sliding manner, as described above, and as the other feature, the second handle 312 is not connected directly to sub-assembly 400, rather it is attached via the connecting link 315' which executes a circular motion in the direction of the arrow $P_4$ to compensate for the "vertical" component of the circular motion $P_3$ and to enable a "lifting" (compare FIG. 4 with FIG. 5) of the second handle 312.

It has been found that the following ratios are advantageous:

(a) The driver arm 314 contacts the jaw carrier 320 within the middle third of the distance l between the pivot points 314*a* and 314*b*, preferably at the mid-point l/2, note FIG. 5.

(b) The distances m and n between 314*b* and 315*b* and between 315*a* and 315*b* respectively are substantially equal and differ from one another by a maximum of about ±25%; and (c) the distance l is three to four times as long as the distance m or n.

Figure 8:
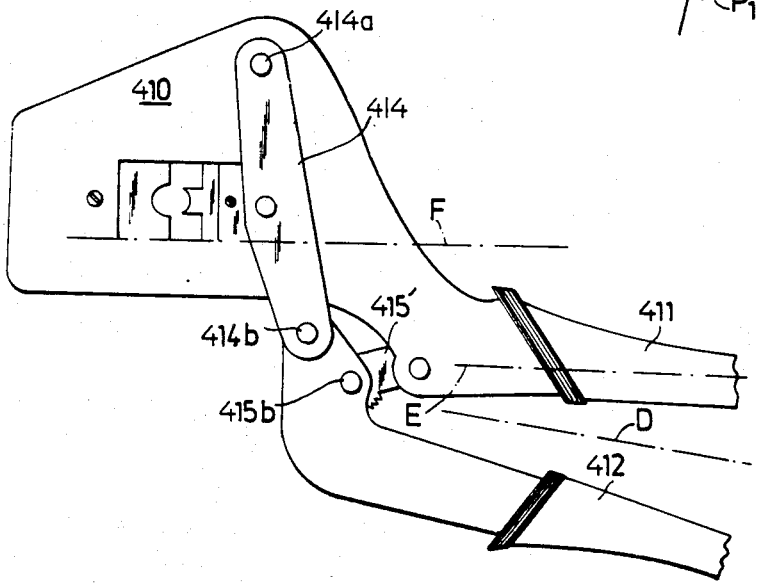
FIG. 8 is a partial side view of an alternative embodiment of the tool illustrated in FIGS. 4 and 5.

In FIG. 8 there is shown an alternative of the tool illustrated in FIGS. 4 and 5 and it differs only in that the direction E of the first handle 411 is essentially parallel with the direction F of the rectilinear movement along the guiding track 413, as is the case in FIG. 1.

The embodiments of FIGS. 2 and 3 differ from the other embodiments illustrated in that the lever arm with a variable length m' in the FIG. 2, effective between the pivot point 115*a* and the axis of the tap 114*b*, or with the variable length p between the axis of the pivot point 214*a* and the engagement points in the slot 314*d* in the embodiment of FIG. 3, has the variable length increased when the second handle 212 is activated, causing, in turn, a somewhat slighter decrease of the value W/V in the course of operation; however, the difference is negligible.

In all of the embodiments of the tool according to the present invention, stress forces affecting the guiding track and/or the jaw carrier transversely of the direction F of the guiding track are intercepted by the driver arm pivoted about a stationary point, and only the forces acting in the direction F are transmitted to the jaw carrier. With the guiding track in the form of a window closed on all sides, and in particular closed on the opposite sides of the jaw carrier, it contributes to attaining a guiding action with minimal wear.

While specific embodiments of the invention have been shown and described in detail to illustrate the application of the inventive principles, it will be understood that the invention may be embodied otherwise without departing from such principles.

We claim:

1. A pliers-type tool comprising a body member, a first handle fixed to and extending outwardly from said body member and combining with said body member to form a rigid sub-assembly unit, said body member forms a rectilinear guiding track extending in a rectilinear direction and having a first end and a second end extending transversely of the rectilinear direction, a slidable carrier mounted in said guiding track for rectilinear movement thereof between the first and second ends thereof, a first working jaw located on said slidable carrier, a second working jaw located at the second end of said guiding track so that said slidable carrier can be moved toward said second working jaw in the relative movement of said first and second ends from an open position into a closed position, a second handle pivotally connected to said sub-assembly unit, an extension fixed to said second handle and extending from the pivotal connection of said second handle to said sub-assembly unit in an opposite direction from said second handle, toggle means in engagement with said second handle for transmitting force and motion from said second handle to said slidable carrier, said toggle means comprises an elongated driver arm means having a first end and a second end and being in contact with said extension of said second handle at a spaced location from the pivotal connection of said second handle to said sub-assembly unit, said driver arm means extends in the elongated direction transversely of the direction of said guiding track extending rectilinearly between the first and second ends thereof, each of said ends of said driver arm means being located on an opposite side of said guiding track, and said driver arm means is at said first end thereof pivotally connected at a stationary location on said sub-assembly unit, and said stationary location being spaced laterally from said guiding track in the direction extending transversely of the direction between the first and the second ends of said guiding track, the contact location of said driver arm means and said extension being spaced on said driver arm means from the location of the pivotal connection of said driver arm means and said sub-assembly unit toward the second end of said driver arm means; when said second handle is pivotally displaced relative to said sub-assembly unit, said extension of said second handle displaces said second end of the driver arm means along a circular arc having a radius extending from the center of the stationary location and said circular arc being located on the opposite side of said guiding track from said stationary location of the pivotal connection of said driver arm to said sub-assembly unit, and said driver arm means is in contacting engagement with said slidable carrier at a location between the point of pivotal connection of said driver arm means and said sub-assembly unit and the contact location of said driver arm means and said extension.

2. A pliers-type tool, as set forth in claim 1, wherein said guiding track includes guiding members extending along two sides of said jaw carrier which are opposite one another in a direction transversal to the rectilinear direction of the guiding track.

3. A pliers-type tool, as set forth in claim 1, wherein said extension is in slidable engagement with said driver arm.

4. A pliers-type tool, as set forth in claim 1, wherein a connecting link pivotally connects said second handle to said sub-assembly unit and said extension is in engagement with a pivot pin connected at a stationary location to said driver arm, whereby said connecting link is adapted to execute pivotal movement so that, upon pivotal movement of said second handle, said pivot pin moves along a circular path centered about the pivotal connection of said driver arm to the stationary location on said sub-assembly unit.

5. A pliers-type tool, as set forth in claim 4, wherein the distance between the pivot points on said connecting link and the distance between the pivot points located on said extension of said second handle do not differ from one another within a range greater than $\pm 25\%$.

6. A pliers-type tool, as set forth in claim 1, wherein the elongated direction (E) of said first handle and a bisector (D) of an angle between said first and second handles when said first and second handles are most remote from one another extends obliquely to the rectilinear direction (F) of said guiding track.

7. A pliers-type tool, as set forth in claim 6, wherein the rectilinear direction (F) of said guiding track forms with the bisector (D) of said first and second handles when said first and second handles are most remote from one another an angle ($\gamma'$) in the range of 45° to 90°, and the rectilinear direction (F) of said guiding track forms an angle ($\gamma$) with the elongated direction (E) of said first handle (11) in the range of 30° to 90°.

8. A pliers-type tool, as set forth in claim 1, wherein a line (A) extending between the stationary point of pivoting said driver arm means relative to said sub-assembly unit and the point of engagement of said extension of said second handle forms an angle ($\alpha$) in the range of 80° to 100° with the rectilinear direction (F) of said guiding track when said jaw carrier is in the closed position of said tool.

9. A pliers-type tool, as set forth in claim 1, wherein a connecting link attaches said second handle to said rigid sub-assembly unit and is pivotally connected to said second handle and sub-assembly unit, and an arresting mechanism is provided on said connecting link for impeding premature opening of said second handle.

10. A pliers-type tool, as set forth in claim 1, wherein at least one of the pivotal connections of said sub-assembly unit to said driver arm, and to said second handle includes a pivot pin comprising a concentric portion and an eccentric portion for adjustment of said closed position by selecting an appropriate rotary position of said pin.

11. A pliers-type tool, as set forth in claim 4, wherein at least one of the pivotal connections of said connecting link includes a pivot pin comprising a concentric portion and an eccentric portion for adjustment of said closed position by selecting an appropriate rotary position of said pin.

* * * * *